US007482790B2

(12) United States Patent
Eberlein

(10) Patent No.: US 7,482,790 B2
(45) **Date of Patent: *Jan. 27, 2009**

(54) VOLTAGE REGULATOR OUTPUT STAGE WITH LOW VOLTAGE MOS DEVICES

(75) Inventor: Matthias Eberlein, Gilching (DE)

(73) Assignee: Dialog Semiconductor GmbH, Kirchheim/Teck-Nobern (DE)

( * ) Notice: Subject to any disclaimer, the term of this patent is extended or adjusted under 35 U.S.C. 154(b) by 6 days.

This patent is subject to a terminal disclaimer.

(21) Appl. No.: 11/725,270

(22) Filed: Mar. 19, 2007

(65) Prior Publication Data

US 2007/0188156 A1 Aug. 16, 2007

Related U.S. Application Data

(62) Division of application No. 11/008,370, filed on Dec. 9, 2004, now Pat. No. 7,199,567.

(30) Foreign Application Priority Data

Dec. 3, 2004 (EP) ..... 04368074

(51) Int. Cl.
*G05F 1/563* (2006.01)
*G05F 1/571* (2006.01)

(52) U.S. Cl. ..... 323/270; 323/273; 323/276

(58) Field of Classification Search ..... 323/273–277, 323/278–281, 303, 226, 270; 361/18, 91.5, 361/91.6, 58; 327/541
See application file for complete search history.

(56) References Cited

U.S. PATENT DOCUMENTS 4,646,219 A * 2/1987 Rohl ..... 363/21.07
5,648,739 A * 7/1997 Walther et al. ..... 327/330
6,188,211 B1 2/2001 Rincon-Mora et al.
6,246,221 B1 6/2001 Xi (Continued)

FOREIGN PATENT DOCUMENTS

EP 1 378 808 A1 1/2004

OTHER PUBLICATIONS

WO 2003 085475 Manfred Mauthe, Circuit Arrangement for Regulating Voltage, WIPO, Oct. 16, 2003, pp. 1-24.*

(Continued)

*Primary Examiner*—Akm E Ullah
*Assistant Examiner*—Harry Behm
(74) *Attorney, Agent, or Firm*—Saile Ackerman LLC; Stephen B. Ackerman

(57) ABSTRACT

Circuits and methods to provide an LDO output stage implemented with low-voltage devices and still allowing higher voltage levels have been achieved. The output stage has been built using two low voltage MOS devices in series. During the time the regulator is in active mode the second MOS device acts as a small resistor in series to the pass device. During power down this second device actively protects the MOS pass device and itself from high voltage stress levels. This is achieved by a robust regulating mechanism that compensates leakage currents. These leakage currents normally determine the different potentials of the output stage during power down. Although the second transistor presents a resistive obstacle during active mode the total chip area required is smaller compared to a single pass device tolerating e.g. 5 Volts.

30 Claims, 5 Drawing Sheets

U.S. PATENT DOCUMENTS

| | | | | |
|---|---|---|---|---|
| 6,265,856 | B1 * | 7/2001 | Cali' et al. | 323/273 |
| 6,304,131 | B1 | 10/2001 | Huggins et al. | |
| 6,333,623 | B1 | 12/2001 | Heisley et al. | |
| 6,661,211 | B1 | 12/2003 | Currelly et al. | |
| 6,665,159 | B2 * | 12/2003 | Takikawa et al. | 361/56 |
| 6,703,813 | B1 * | 3/2004 | Vladislav et al. | 323/270 |
| 7,071,664 | B1 * | 7/2006 | Teggatz et al. | 323/280 |
| 2003/0111986 | A1 | 6/2003 | Xi | |
| 2003/0122613 | A1 | 7/2003 | Perez | |
| 2003/0178978 | A1 | 9/2003 | Biagi et al. | |

OTHER PUBLICATIONS

"A Low-Voltage, Low Quiescent Current, Low Drop-Out Regulator", IEEE Journal of Solid-State Circuits, vol. 33, No. 1, Jan. 1998, by Gabriel A. Rincon-Mora et al., pp. 36-44.

* cited by examiner

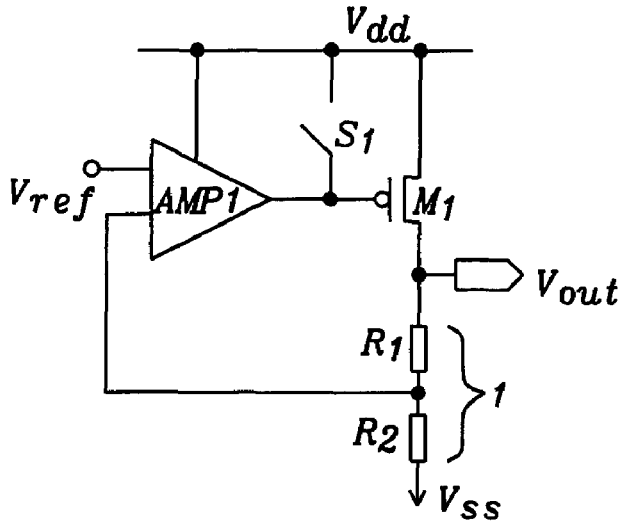
FIG. 1 – Prior Art
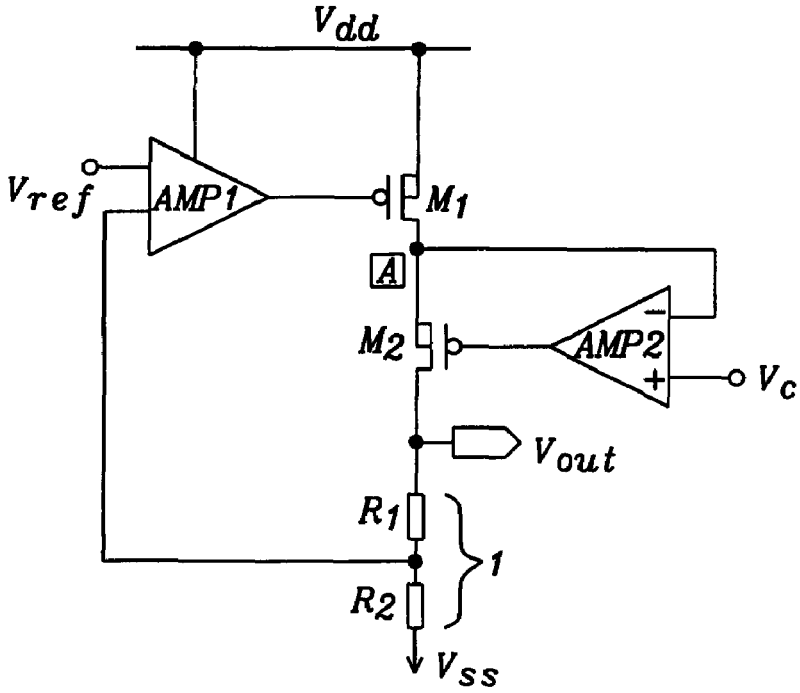
FIG. 2

ENTER
HB
2/21/08

VOLTAGE REGULATOR OUTPUT STAGE WITH LOW VOLTAGE MOS DEVICES

This is a divisional application of U.S. patent application Ser. No. 11/008,370, filed on Dec. 9, 2004, now U.S. Pat. No. 7,199,567 which is herein incorporated by reference in its entirety, and assigned to a common assignee.

BACKGROUND OF THE INVENTION (1) Field of the Invention

This invention relates generally to voltage regulators, and more particularly to low dropout (LDO) voltage regulators having low voltage devices still allowing higher voltage levels.

(2) Description of the Prior Art

Low-dropout (LDO) linear regulators are commonly used in all kind of mobile electronic devices to provide power to digital circuits, where point-of-load regulation is important. In prior art generally LDOs must operate with high input voltage levels up to 5.5 Volts or more requiring equally tolerant CMOS devices.

FIG. 1 prior art shows a typical standard concept of an LDO with a single pass device $M_1$, a voltage divider 1 comprising resistors $R_1$ and $R_2$ providing feedback to the differential amplifier AMP1, and a switch $S_1$. The differential amplifier compares the feedback voltage of the voltage divider 1 with a reference voltage $V_{REF}$. During power down, switch $S_1$ is closed to block any current through pass device $M_1$. Therefore the output voltage $V_{OUT}$ becomes 0 Volt, creating at pass device $M_1$ a drain-source voltage equal to $V_{DD}$. Using prior art circuits pass devices tolerant for relative high voltages are required to cope with this kind of voltage levels. Especially to avoid stress during power down the pass device has to be at least 5 Volts tolerant. This means that large chip areas and high production costs are required yielding to low performance of such devices in deep sub-micron processes.

There are patents known dealing with LDO circuits:

U.S. Pat. No. (6,661,211 to Currelly et al.) teaches a quick-starting low-voltage DC power supply circuit having a switch mode DC-to-DC converter connected to a DC supply source. A low-dropout-regulator (LDO) connected in parallel with the switch-mode DC to DC converter, and a diode is connected in series with the output of the low-dropout-regulator connecting the output of the low-dropout-regulator to the output of the switch-mode DC-to-DC converter. The arrangement is such that the start-up output voltage of the circuit is the output voltage of the low-dropout-regulator and the long-term output voltage of the circuit is supplied by the switch-mode DC-to-DC converter output.

U.S. Pat. No. (6,333,623 to Hesley et al.) discloses a low drop-out (LDO) voltage regulator including an output stage of having a pass device and a discharge device arranged in complementary voltage follower configurations to both source load current to and sink load current from a regulated output voltage conductor. The pass device and the discharge device are controlled through a single feedback loop.

U.S. Pat. No. (6,188,211 to Rincon-Mora) discloses a low drop-out (LDO) voltage regulator and system including the same. An error amplifier controls the gate voltage of a source follower transistor in response to the difference between a feedback voltage from the output and a reference voltage. The source of the source follower transistor is connected to the gates of an output transistor, which drives the output from the input voltage in response to the source follower transistor. A current mirror transistor has its gate also connected to the gate of the output transistor, and mirrors the output current at a much reduced ratio. The mirror current is conducted through a network of transistors, and controls the conduction of a first feedback transistor and a second feedback transistor, which are each, connected to the source of the source follower transistor and in parallel with a weak current source. The response of the first feedback transistor is slowed by a resistor and capacitor, while the second feedback transistor is not delayed. As such, the second feedback transistor assists transient response, particularly in discharging the gate capacitance of the output transistor, while the first feedback transistor partially cancels load regulation effects.

Furthermore Gabriel Rincon-Mora describes "A low-Voltage, Low-quiescent Current LDO Regulator" in IEEE Journal of Solid States Circuits, Vol 33, no 1, January 1998.

SUMMARY OF THE INVENTION

A principal object of the present invention is to achieve an output stage of an LDO voltage regulator using low voltage devices and allowing higher voltages.

In accordance with the objects of this invention a circuit for an LDO output stage implemented with low-voltage devices and still allowing higher voltage levels has been achieved. The circuit invented is comprising, first, a first low-voltage PMOS pass device having its source connected to VDD voltage and to its bulk, its gate is controlled by said LDO regulator, its drain is connected to a means of controllable resistance. Furthermore the circuit comprises said means of controllable resistance, protecting actively the voltage level at the drain of said PMOS pass device, which is implemented between the drain of said first PMOS pass device and an output port of the voltage regulator.

In accordance with the objects of this invention another circuit for an LDO output stage implemented with low-voltage devices and still allowing higher voltage levels has been achieved. The circuit invented is comprising, first, a first low-voltage PMOS pass device having its source connected to VDD voltage and to its bulk, its gate is controlled by said LDO regulator, its drain is connected to a means of controllable resistance. This means of controllable resistance, protecting actively the voltage level at the drain of said PMOS pass device, is implemented between the drain of said first PMOS pass device and an output port of the voltage regulator. Furthermore the circuit comprises a first voltage limiting means implemented in parallel to said first PMOS pass device and a second voltage limiting means implemented in parallel to said means of controllable resistance.

In accordance with the objects of this invention another circuit for an LDO output stage implemented with low-voltage devices and still allowing higher voltage levels has been achieved. The circuit invented is comprising, first, a first low-voltage NMOS pass device having its source connected to its bulk and to an output port of said LDO regulator, its gate controlled by said LDO regulator, and its drain is connected to a means of controllable resistance. This means of controllable resistance, protecting actively the voltage level at the drain of said NMOS pass device, is implemented between the drain of said first NMOS pass device on one side and on the other side connected to $V_{DD}$ voltage.

In accordance with the objects of this invention a further circuit for an LDO output stage implemented with low-voltage devices and still allowing higher voltage levels has been achieved. The circuit invented is comprising, first, a first low-voltage NMOS pass device having its source connected to its bulk and to an output port of said LDO, its gate is controlled by said LDO regulator, its drain is connected to a means of controllable resistance. This means of controllable resistance, protecting actively the voltage level at the drain of said NMOS pass device, is implemented between the drain of said first NMOS pass device and $V_{DD}$ voltage. Furthermore the circuit comprises a first voltage limiting means implemented in parallel to said first NMOS pass device and a second voltage limiting means implemented in parallel to said means of controllable resistance.

In accordance with the objects of this invention a method to provide an LDO output stage implemented with low-voltage devices and still allowing higher voltage levels has been achieved. The method comprises, first, to provide a PMOS pass device, switching means to activate power-off and power-on, two voltage limiting means and a means to achieve a controllable resistance. The following step is to clamp the voltage at the source of the PMOS pass device during power-off to a level below the maximal tolerable voltage of said pass device, wherein said voltage is maximal 0.5 $V_{DD}$ voltage.

In accordance with the objects of this invention another method to provide an LDO output stage implemented with low-voltage devices and still allowing higher voltage levels has been achieved. The method comprises, first, to provide an NMOS pass device, switching means to activate power-off and power-on, two voltage limiting means and a means to achieve a controllable resistance. The following step is to clamp the voltage at the drain of said NMOS device during power-off to a level below the maximal tolerable voltage of said pass device, wherein said voltage is maximal 0.5 $V_{DD}$ voltage.

BRIEF DESCRIPTION OF THE DRAWINGS

In the accompanying drawings forming a material part of this description, there is shown:

FIG. 1 prior art shows a typical standard concept of an LDO voltage converter FIG. 2 illustrates the principal layout of the output stage invented using a second PMOS device.

DESCRIPTION OF THE PREFERRED EMBODIMENTS

Figure 3:
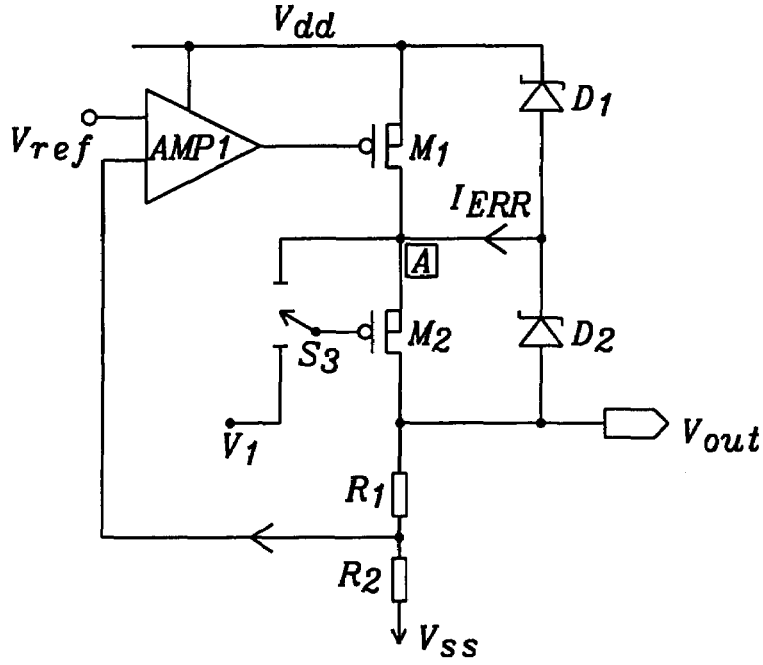
FIG. 3 shows an embodiment of the output stage invented using Zener diodes to limit the voltage upon the PMOS devices.

The preferred embodiments of the present invention disclose novel circuits and methods for the output stage of LDO voltage regulators using low voltage devices while still allowing higher voltage levels.

For many applications, especially for mobile electronic devices an LDO voltage regulator requires e.g. a high voltage tolerating PMOS pass device at the output in order to tolerate e.g. a typical input voltage range of 3 Volts to 5.5 Volts. Unfortunately these transistors have poor analog performance in low voltage processes and require a large area due to channel length restrictions. The invention teaches how the output stage of an LDO voltage regulator can be built using two low voltage PMOS devices in series. Low voltage means in this context a voltage in the order of magnitude of half the VDD voltage, using the example cited above, these low voltages devices have to tolerate 2.75 Volts only.

During the time the regulator is in active mode the second PMOS device acts as a small resistor in series to the pass device. During power down this second device actively protects the PMOS pass device and itself from high voltage stress levels. This is achieved by a robust regulating mechanism that compensates leakage currents. These leakage currents normally determine the different potentials of the output stage during power down.

FIG. 2 illustrates the principles and one embodiment of the present invention. Additional to the circuit shown in FIG. 1 prior art is a second PMOS device $M_2$ connected in series to the pass device $M_1$. $M_2$ has its bulk tied to the source. Both devices $M_1$ and $M_2$ are low voltage (e.g. 2.5 Volts) tolerant devices now, while the pass device shown in FIG. 1 prior art has to withstand a higher voltage level. Furthermore a separate amplifier AMP2 regulates the gate of $M_2$ to keep the voltage at node A at a defined level $V_C$. Preferably this voltage $V_C$ is maximal 0.5 $V_{DD}$.

During power down phase (PD=1) only leakage currents are flowing through both devices, $M_1$ and $M_2$. The amplifier AMP2 controls then the effective resistance of $M_2$ to provide a suitable voltage at node A, so that the voltage seen between either terminals of $M_1$ and $M_2$ does not exceed its maximum tolerable value $V_{MAX}$ which may be e.g. 2.5 Volts.

Preferably $M_2$ has a similar size as pass device $M_1$. This is advantageous to reduce excess power loss during active mode. Then the gate potential of $M_2$ will automatically adjust to a value being very close to the potential at node A. As a result, $M_2$ is not overloaded, too, since it experiences only voltage levels of $V(A)-V_{OUT}=V(A)$. During power down (PD=1) the voltage $V_{OUT}$ becomes zero. Therefore the principle works well provided $V_{DD}<2\times V_{MAX}$, wherein $V_{MAX}$ is the maximum tolerable voltage level of the low voltage devices selected.

During power on phase (PD=0) the voltage regulator stabilizes $V_{OUT}$ to a given positive value. In this case the amplifier AMP2 automatically pulls the gate of $M_2$ down to $V_{SS}$ since it tries unsuccessfully to keep node A low. Therefore $M_2$ behaves here like a closed switch with a low resistance.

FIG. 3 illustrates a preferred embodiment of the present invention. The zener diodes D1 and D2 are connected in series having their midpoint connected to node A. They provide effectively the same behaviour as described above for FIG. 2. Both zener diodes D1 and D2 become conductive only if their voltage exceeds their threshold voltage $V_Z$. Preferably the zener diodes D1 and D2 are both identical.

Figure 9:
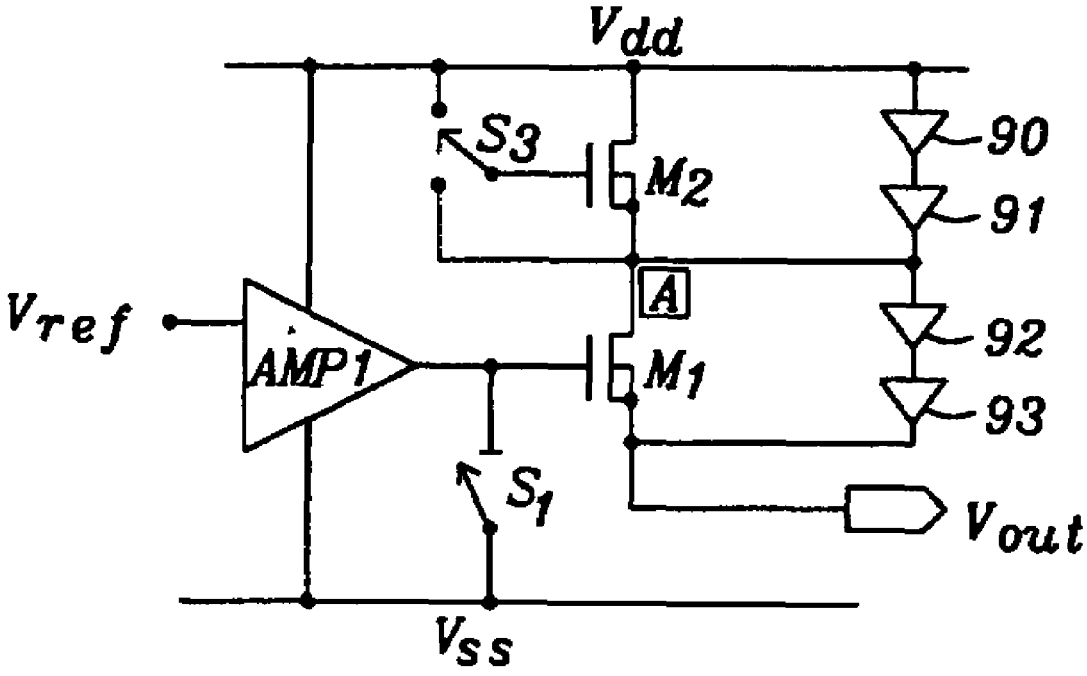
FIG. 9 illustrates a simple realization suitable for CMOS process by a multiple series connection of MOS diodes.

FIG. 9 illustrates a simple realization suitable for CMOS process by a multiple series connection of MOS diodes. This means to realize the behaviour of such zener diodes, shown in FIG. 6, by connecting several diodes $D_{90}$-$D_{91}$, and $D_{92}$-$D_{93}$, in series so that the threshold values of each pair of diodes add up to a total, which is equal to $V_z$. In that sense the series connection performs the same clamping function as a zener diode, although there is no breakthrough but the diodes are forward biased for voltages above the total threshold. For that purpose any kind of diodes can be used which are suitable for a fabrication process.

Then the threshold voltage $V_Z$ corresponds to the sum of their MOS threshold voltages. By choosing $V_Z$ in the order of magnitude of the maximal tolerable voltage level $V_{MAX}$ or slightly smaller they effectively protect node A from drifting towards $V_{SS}$ or $V_{DD}$. Any drifting would cause an error current $I_{ERR}$ which compensates the leakage causing the drifting. Effectively node A is clamped to stay within a range between ($V_{DD}$-$V_Z$) and $V_Z$. Preferably $V_Z$ is a value between $V_{DD}/2$ and $V_{MAX}$. Then the voltage level at node A never exceeds $V_{MAX}$ relative to $V_{DD}$ or $V_{SS}$. The Zener diodes D1 and D2 have a voltage limiting function.

During a power down phase (PD=1) the gate of $M_2$ is connected to node A via toggle switch S3. During a power on phase (PD=0) the gate of $M_2$ is switched to a reference voltage $V_1$. In most cases this reference voltage $V_1$ would be 0 Volt. This makes $M_2$ behaving like a small resistor in active mode. Usually an arrangement of transistors is used to implement toggle switch S3.

Figure 4:
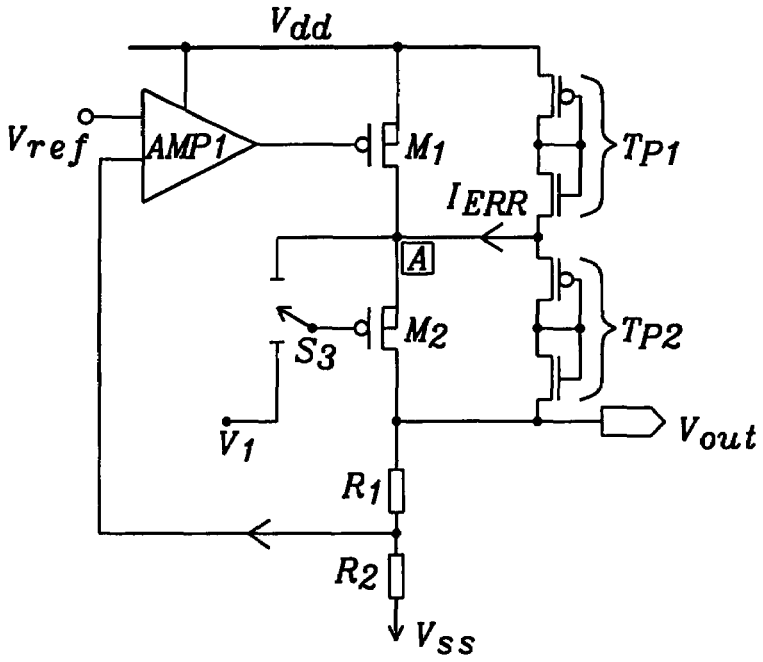
FIG. 4 shows an alternative embodiment of the output stage invented using two pairs of diode-connected transistors to limit the voltage upon the PMOS devices.

It should be understood that the voltage divider 1 and the differential amplifier AMP1 shown in FIGS. 2-4 are shown for the sake of completeness only. They are not part of the present invention. A differential amplifier and a voltage divider are standard components of almost every LDO voltage regulator.

FIG. 4 shows an alternative implementation of the present invention using the same principles. Instead of the Zener diodes D1 and D2 shown in FIG. 3 two pairs $T_{P1}$ and $T_{P2}$ of transistors are limiting the voltage upon devices $M_1$ and $M_2$. Each pair comprises a PMOS transistor and an NMOS transistor both being diode connected. This means both NMOS and PMOS transistors have their gates connected with their drains and both drains are connected also connected. Such a pair of transistors has a very similar behaviour as a Zener diode, and the break-through can be adjusted in the order of magnitude of $V_{MAX}$.

It has to be understood that FIG. 4 shows only one example of multiple alternatives how the clamping can be realized with simple MOS diodes. It depends upon the specific application (and on the individual MOS threshold values and the required VZ value) how many diodes are connected in series. Even a realization with bipolar diodes is possible. The behaviour is different to Zener diodes in the sense that no breakthrough effect is exploited. A series connection of e.g. MOS diodes does not conduct current as long as the total voltage drop is smaller than the addition of their individual threshold voltages. They will conduct a small error compensating current in forward biasing state when the clamping voltage is reached.

As zener diodes are not easily available in standard CMOS processes an implementation using MOS transistors can be more cost-efficient.

Figure 5:
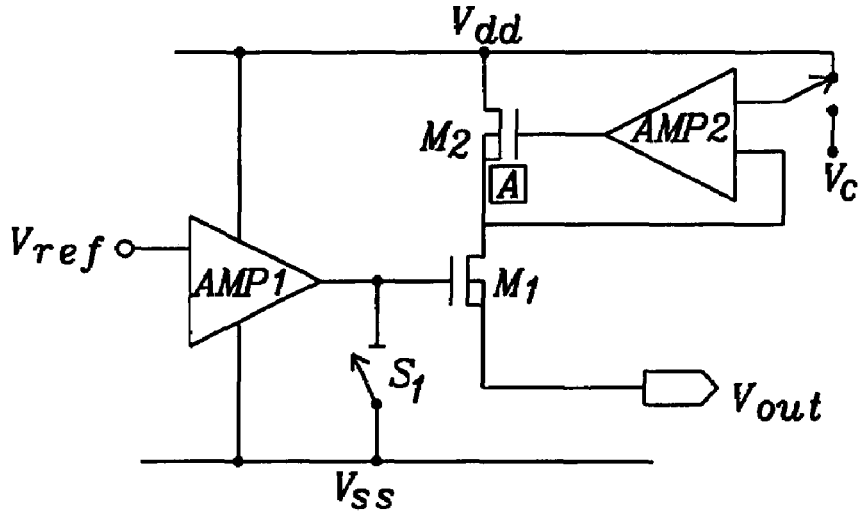
FIG. 5 illustrates the principal layout of the output stage invented using a second NMOS device.

FIG. 5 shows an embodiment of the present invention using NMOS transistors correspondent to the output stage shown in FIG. 2 wherein PMOS transistors have been used.

The source of NMOS pass device M1 is connected to its bulk and correspondingly the source of $M_2$ is also connected to its bulk. The output port of the output stage is connected to the source of NMOS pass device M1. A voltage divider providing a feedback voltage to amplifier AMP1 is not shown, because it is not subject of the present invention.

A first input of the amplifier AMP2 is connected to node A, a second input is connected to $V_{DD}$ voltage via switch S2 during power on (PD=0). During a power down phase (PD=1) this second input is connected to a reference voltage $V_C$. Switch S1 controls the connection of the gate of M1 with $V_{SS}$ voltage, it is closed during power down phase and open during power on.

Figure 6:
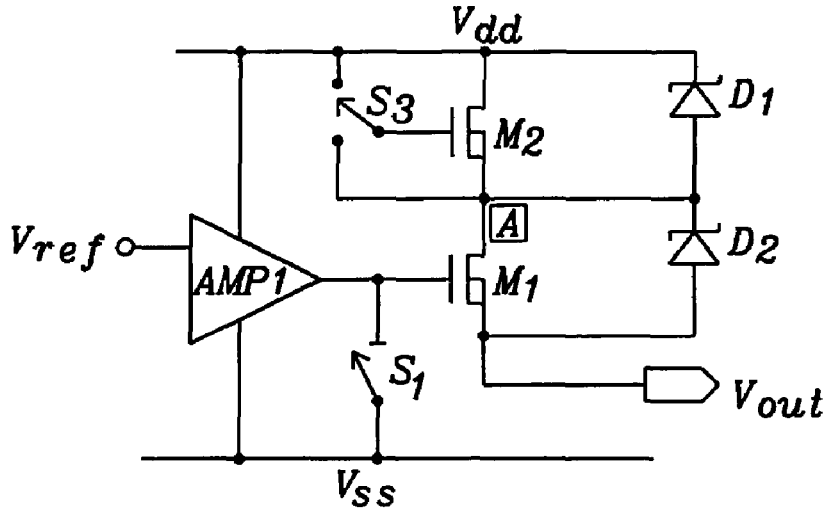
FIG. 6 shows an embodiment of the output stage invented using Zener diodes to limit the voltage upon NMOS devices.

FIG. 6 shows another embodiment of the present invention using NMOS transistors correspondent to the output stage shown in FIG. 3 wherein PMOS transistors have been used.

Accordingly to the circuit shown in FIG. 3 the Zener diodes D1 and D2 clamp the voltage at node A, protecting the NMOS devices M1 and M2. As explained above with FIG. 3 any kind of diodes can be used which are suitable for a fabrication process for this purpose.

Figure 7:
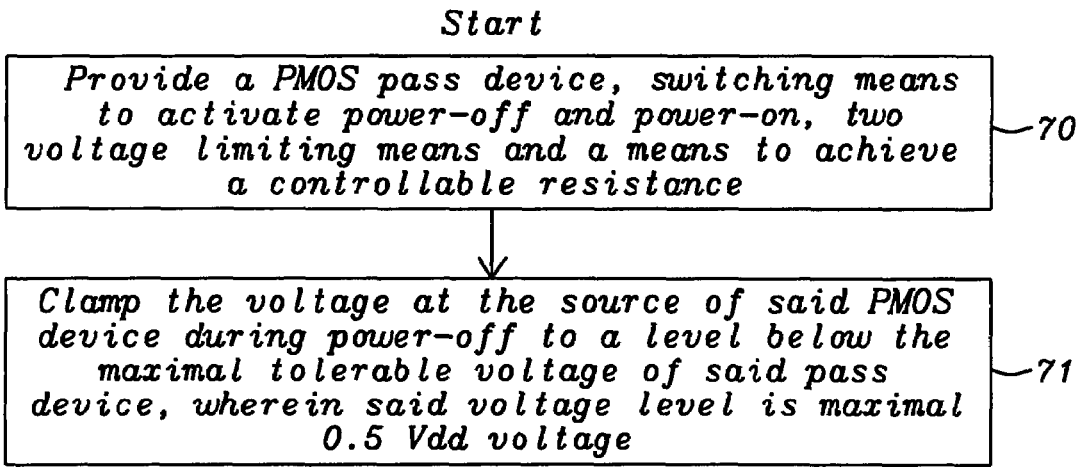
FIG. 7 shows a flowchart of the principal steps of a method to use low-voltage PMOS devices for an LDO output stage while still allowing higher voltages.

During power down phase switch S1 is closed and switch S3 connects the gate of the NMOS device M2 with node A. During power on switch S1 is open and switch S3 connects the gate of the NMOS device M2 with $V_{DD}$ voltage, FIG. 7 shows a flowchart of the principal steps of a method to use low-voltage devices for an LDO output stage while still allowing higher voltages. Step 70 describes the provision of a PMOS pass device, switching means to activate power-on and power-off, two voltage limiting means, and a means to achieve a controllable resistance. This means to achieve a controllable resistance could be e.g. the arrangement of Zener diodes, of serially connected diodes, diode connected transistors, MOS transistor $M_2$ and switch S3 as explained and shown in FIG. 3 and in FIG. 4, or the amplifier AMP2 and device M2 as shown in FIG. 2.

Step 71 illustrates that the voltage at the source of said PMOS pass device is clamped during power off of said pass device to a level below the maximum tolerable voltage of said pass device, wherein said voltage level is maximal 0.5 Vdd voltage. Therefore the PMOS pass device is encountering a voltage level of maximal 0.5 $V_{DD}$ voltage only. As described above with FIGS. 2, 3 and 4, there are different means available to control resistance and to limit the voltage upon the devices $M_1$ and $M_2$.

Figure 8:
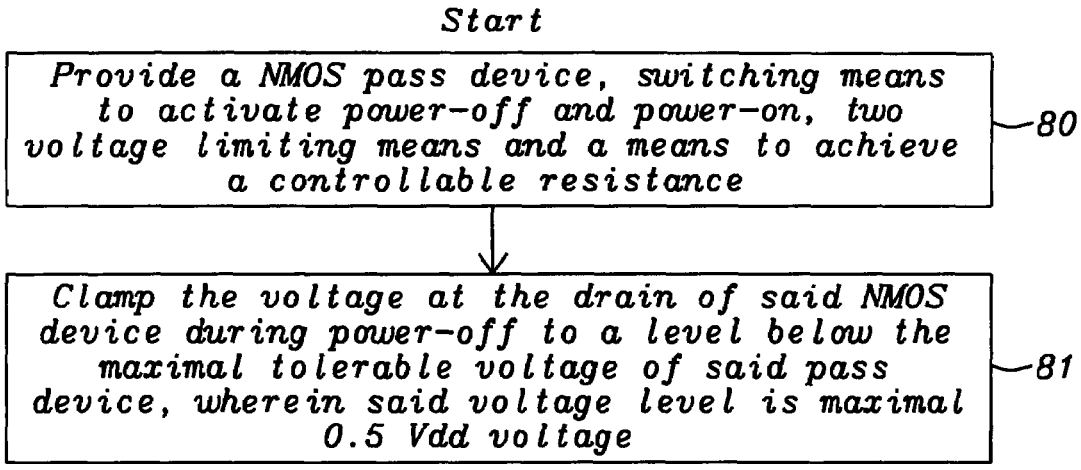
FIG. 8 shows a flowchart of the principal steps of a method to use low-voltage NMOS devices for an LDO output stage while still allowing higher voltages.

FIG. 8 shows a flowchart of the principal steps of another method to use low-voltage NMOS devices for an LDO output stage while still allowing higher voltages. Step 80 describes the provision of an NMOS pass device, switching means to activate power-on and power-off, two voltage limiting means, and a means to achieve a controllable resistance. This means to achieve a controllable resistance could be e.g. the arrangement of Zener diodes, of serially connected diodes, diode connected transistors, as explained and shown in the example of FIG. 6 or the amplifier AMP2 and device M2 as shown in FIG. 5.

Step 81 illustrates that the voltage at the drain of said NMOS pass device is clamped during power-off of said pass device to a level below the maximum tolerable voltage of said pass device, wherein said tolerable voltage level is maximal 0.5 Vdd voltage. Therefore the NMOS pass device is encountering a voltage level of maximal 0.5 $V_{DD}$ voltage only. As described above with FIGS. 5 and 6 there are different means available to control resistance and to limit the voltage upon the devices $M_1$ and $M_2$.

Although the second transistor presents a resistive obstacle during active mode the total chip area required is smaller compared to a single pass device tolerating e.g. 5 Volts. It has to be understood that the present invention reduces the maximum voltage the pass devices have to tolerate not only for a 5 Volt LDO but for all other voltage ranges as well. A further advantage is that the low voltage devices have larger gm and less parasitic capacitances allowing better performance for the whole LDO. The present invention allows building e.g. 5 V voltage regulators within a pure 2.5 V device domain. This can in some cases prevent the need of a high voltage process.

While the invention has been particularly shown and described with reference to the preferred embodiments thereof, it will be understood by those skilled in the art that various changes in form and details may be made without departing from the spirit and scope of the invention.

What is claimed is:

1. A circuit of an output stage of an LDO voltage regulator, implemented with low-voltage devices and still allowing higher voltage levels is comprising:

a first low-voltage PMOS pass device having its source connected to VDD voltage and to its bulk, its gate is controlled by said LDO voltage regulator, its drain is connected to a means of controllable resistance;

said means of controllable resistance protecting actively a voltage level at the drain of said PMOS pass device being implemented between the drain of said first PMOS pass device and an output port of the LDO voltage regulator;

a first voltage limiting means implemented in parallel to said first PMOS pass device wherein said first voltage limiting means is a serial arrangement of one or more diodes wherein an addition of their individual threshold voltages corresponds to a maximal tolerable voltage level of said pass device; and a second voltage limiting means implemented in parallel to said means of controllable resistance wherein said second voltage limiting means is a serial arrangement of one or more diodes.

2. The circuit of claim 1 wherein said diodes are bipolar diodes.

3. The circuit of claim 1 wherein said diodes are diode connected transistors.

4. The circuit of claim 1 wherein said first voltage limiting means is a PMOS transistor connected in series with an NMOS transistor wherein the source of said PMOS transistor is connected to VDD voltage, its gate is connected to its drain and to the drain and to the gate of said NMOS transistor and the source of said NMOS transistor is connected to the drain of said PMOS pass device.

5. The circuit of claim 4 wherein the threshold voltage of said arrangement of both PMOS and NMOS transistors corresponds to the maximal tolerable voltage level of said pass device.

6. The circuit of claim 1 wherein said second voltage limiting means is a serial arrangement of one or more diodes wherein the addition of their individual threshold voltages corresponds to the maximal tolerable voltage level of said pass device.

7. The circuit of claim 6 wherein said diodes are bipolar diodes.

8. The circuit of claim 6 wherein said diodes are diode connected transistors.

9. The circuit of claim 1 wherein said second voltage limiting means is a PMOS transistor connected in series with an NMOS transistor wherein the source of said PMOS transistor is connected to the drain of said PMOS pass device voltage, its gate is connected to its drain and to the drain and to the gate of said NMOS transistor and the source of said NMOS transistor is connected to the output port of the voltage regulator.

10. The circuit of claim 9 wherein said the breakthrough voltage of said arrangement of both PMOS and NMOS transistors corresponds to the maximal tolerable voltage level of said pass device.

11. The circuit of claim 1 wherein said means to achieve a controllable resistance has a low resistance during a power-on phase of said voltage regulator and during a power-down phase it actively protects said PMOS pass device.

12. The circuit of claim 11 wherein said means to achieve a controllable resistance comprise a PMOS transistor and a toggle switch, wherein said toggle switch connects the gate of said PMOS transistor with the source of said PMOS transistor during said power-off phase and connects the gate of the PMOS transistor with a reference voltage during said power on phase, wherein the source of the PMOS transistor is connected to the drain of said PMOS pass device and the drain of said PMOS transistor is connected to the output port of said voltage regulator.

13. The circuit of claim 12 wherein said toggle switch is implemented using an arrangement of transistors.

14. The circuit of claim 12 wherein said PMOS transistor has its bulk connected with its source.

15. The circuit of claim 14 wherein said PMOS transistor has the same size as said PMOS pass device.

16. A circuit of an output stage of an LDO voltage regulator implemented with low-voltage devices and still allowing higher voltage levels is comprising:

a first low-voltage NMOS pass device having its source connected to its bulk and to an output port of said LDO voltage regulator, its gate is controlled by said LDO voltage regulator, its drain is connected to a means of controllable resistance;

said means of controllable resistance protecting actively a voltage level at the drain of said NMOS pass device being implemented between the drain of said first NMOS pass device and $V_{DD}$ voltage;

a first voltage limiting means implemented in parallel to said first NMOS pass device wherein said first voltage limiting means is a serial arrangement of one or more diodes wherein an addition of their individual threshold voltages corresponds to a maximal tolerable voltage level of said pass device; and a second voltage limiting means implemented in parallel to said means of controllable resistance wherein said second voltage limiting means is a serial arrangement of one or more diodes.

17. The circuit of claim 16 wherein said diodes are bipolar diodes.

18. The circuit of claim 16 wherein said diodes are diode connected transistors.

19. The circuit of claim 16 wherein said first voltage limiting means is a PMOS transistor connected in series with an NMOS transistor wherein the source of said PMOS transistor is connected to VDD voltage, its gate is connected to its drain and to the drain and to the gate of said NMOS transistor and the source of said NMOS transistor is connected to the drain of said NMOS pass device.

20. The circuit of claim 19 wherein the threshold voltage of said arrangement of both PMOS and NMOS transistors corresponds to the maximal tolerable voltage level of said pass device.

21. The circuit of claim 16 wherein said second voltage limiting means is a serial arrangement of one or more diodes wherein the addition of their individual threshold voltages corresponds to the maximal tolerable voltage level of said pass device.

22. The circuit of claim 21 wherein said diodes are bipolar diodes.

23. The circuit of claim 21 wherein said diodes are diode connected transistors.

24. The circuit of claim 16 wherein said second voltage limiting means is a PMOS transistor connected in series with an NMOS transistor wherein the source of said PMOS transistor is connected to the drain of said NMOS pass device voltage, its gate is connected to its drain and to the drain and to the gate of said NMOS transistor and the source of said NMOS transistor is connected to the output port of the voltage regulator.

25. The circuit of claim 24 wherein said the breakthrough voltage of said arrangement of both PMOS and NMOS transistors corresponds to the maximal tolerable voltage level of said pass device.

26. The circuit of claim 16 wherein said means to achieve a controllable resistance has a low resistance during a power-on phase of said voltage regulator and during a power-down phase it actively protects said NMOS pass device.

27. The circuit of claim 26 wherein said means to achieve a controllable resistance comprise a NMOS transistor and a toggle switch, wherein said toggle switch connects the gate of said NMOS transistor with the source of said NMOS transistor during power-off phase and connects the gate of said NMOS transistor with $V_{DD}$ voltage during power-on phase, wherein the source of the NMOS transistor is connected to the drain of said NMOS pass device and the drain of said NMOS transistor is connected to $V_{DD}$ voltage.

28. The circuit of claim 27 wherein said toggle switch is implemented using an arrangement of transistors.

29. The circuit of claim 27 wherein said NMOS transistor has its bulk connected with its source.

30. The circuit of claim 27 wherein said PMOS transistor has the same size as said PMOS pass device.

* * * * *